United States Patent [19]

Theurer et al.

[11] Patent Number: 5,046,270

[45] Date of Patent: Sep. 10, 1991

[54] MOBILE BALLAST CLEARING AND PLANING MACHINE

[75] Inventors: Josef Theurer, Vienna; Johann Hansmann, Klosterneuburg; Wörgötter, Linz, all of Austria

[73] Assignee: Franz Plasser Bahnbaumaschinen-Industriegesellschaft m.b.H., Vienna, Austria

[21] Appl. No.: 353,185

[22] Filed: May 15, 1989

Related U.S. Application Data

[63] Continuation of Ser. No. 164,792, Mar. 7, 1988, abandoned.

[30] Foreign Application Priority Data

Jul. 23, 1987 [AT] Austria ..... 1875/87

[51] Int. Cl.[5] ..... E02F 5/22

[52] U.S. Cl. ..... 37/104; 104/7.2

[58] Field of Search ..... 37/104, 105; 104/7 A, 104/9, 7.2

[56] References Cited

U.S. PATENT DOCUMENTS

| | | | |
|---|---|---|---|
| 3,339,493 | 9/1967 | Bryan, Jr. | 37/104 X |
| 3,731,410 | 5/1973 | Cripe | 37/104 |
| 4,064,807 | 12/1977 | Theurer | 104/7 A |
| 4,102,066 | 7/1978 | Christoff | 37/104 |
| 4,430,813 | 2/1984 | Valditerra et al. | 37/104 |
| 4,611,541 | 9/1986 | Theurer | 104/2 |
| 4,682,428 | 7/1987 | Bryan, Jr. | 104/7 |

FOREIGN PATENT DOCUMENTS

| | | | |
|---|---|---|---|
| 2230202 | 8/1973 | Fed. Rep. of Germany | 37/104 |

*Primary Examiner*—Edgar S. Burr
*Assistant Examiner*—Kimberly L. Asher
*Attorney, Agent, or Firm*—Collard, Roe & Galgano

[57] ABSTRACT

A mobile machine for clearing and planing ballast comprises a machine frame, undercarriages supporting the machine frame for mobility on the railroad track, at least one vertically and transversely adjustable ballast clearing tool connected to the machine frame for clearing ballast laterally outwardly of a respective rail and for planing the ballast upon vertical and transverse adjustment of the tool, the tool being longitudinally adjustably mounted on the machine frame for adjustment in the direction of the railroad track supported by the ballast, and drives connected to the tool for vertically, transversely and longitudinally adjusting the tool.

12 Claims, 2 Drawing Sheets

MOBILE BALLAST CLEARING AND PLANING MACHINE

This is a continuation of our copending application Ser. No. 164,792, filed Mar. 7, 1988, now abandoned.

BACKGROUND OF THE INVENTION

1. Field of the Invention

The present invention relates to a mobile machine for clearing and planing ballast supporting a railroad track consisting of rails fastened to ties defining cribs therebetween, which comprises a machine frame, undercarriages supporting the machine frame for mobility on the railroad rack, and at least one vertically and transversely adjustable ballast clearing tool connected to the machine frame for clearing ballast laterally outwardly of a respective one of the rails and for planing the ballast upon vertical and transverse adjustment of the tool.

2. Description of the Prior Art

German patent No. 2,230,202, of Aug. 16, 1973, discloses a method and device for clearing ballast from a track bed. This ballast removing device or scarifier comprises plate-shaped ballast clearing and planing tools which are vertically and transversely adjustably mounted on a cantilevered front portion of the machine frame. The ballast clearing plates are preceded by a longitudinally displaceable push rod which may be drive to push a respective tie whose fastening elements have been slightly loosened to enable the ballast clearing plates to push the ballast under the displaced tie towards the track shoulder.

SUMMARY OF THE INVENTION

It is the primary object of this invention to provide a ballast scarifier of this general type which enables the ballast in a single crib or in several adjacent cribs, as well as in the area where the ties are supported on the ballast, to be simply and dependably cleared and planed.

The above and other objects are accomplished according to the invention by mounting the ballast clearing tool longitudinally adjustably on the machine frame for adjustment in the direction of the railroad track, respective drives being connected to the tool for vertically, transversely and longitudinally adjusting the tool.

The longitudinal adjustment of the ballast clearing tool enables the tool to clear and plane wider ballast areas. In this way, it is possible to clear and plane a ballast area from which several ties have been withdrawn in a single operating phase. The machine, therefore, makes it possible in an unexpectedly simple manner to surface and ballast of longer track sections rationally, uniformly and rapidly while also enabling single cribs to be cleared and planed without the need for modifying the structure.

The above objects, advantages and features of the present invention will become more apparent from the detailed description of presently preferred embodiments thereof, taken in conjunction with the accompanying, somewhat schematic drawing.

Throughout the specification and claims, the term "standard railroad vehicle" designates a work vehicle which has the dimensions and capacity to enable it to run on a railroad track like any regulator railroad car.

Figure 1:
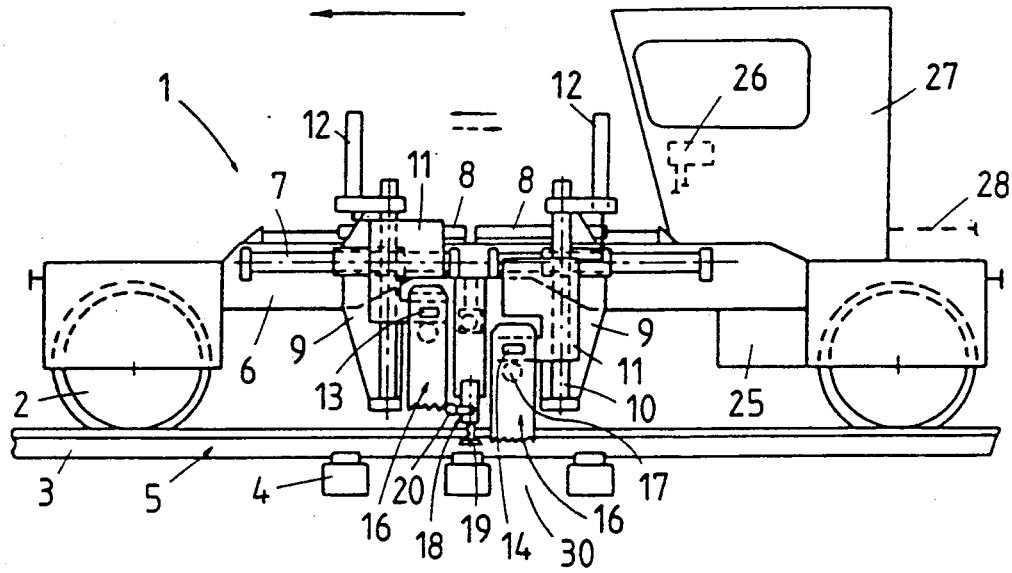
FIG. 1 is a side elevational view of one embodiment of a ballast clearing and planing machine with a track lifting device.
Figure 2:
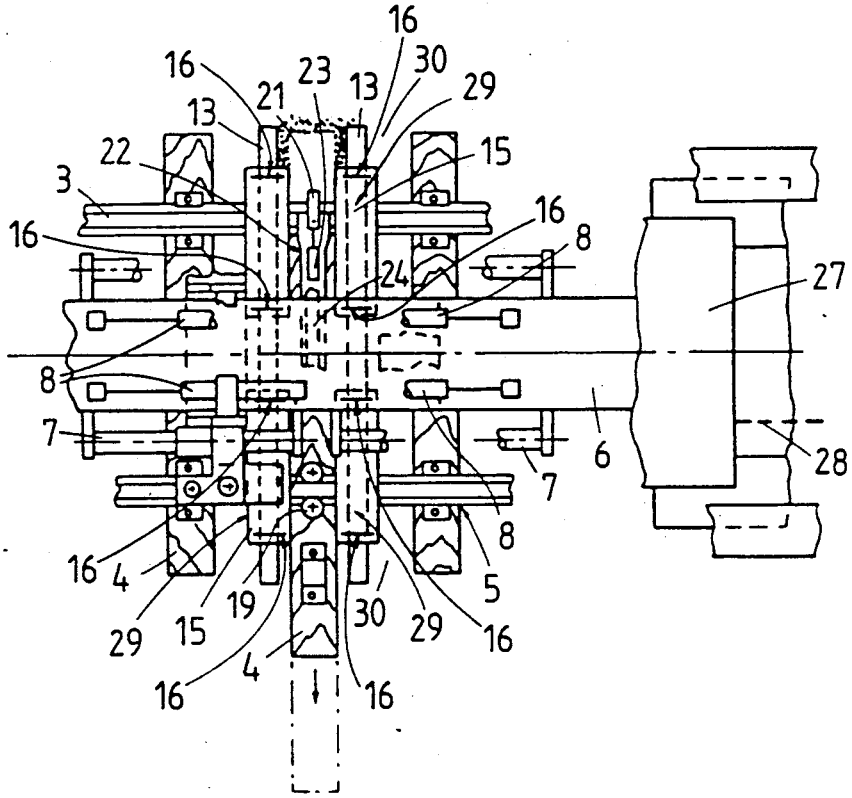
FIG. 2 is a top view of the machine of FIG. 1.

Referring now to the drawing and first to FIGS. 1 and 2, there is shown mobile machine 1 for clearing and planing ballast supporting railroad track 5 consisting of rails 3 fastened to ties 4 defining cribs 30 therebetween. The machine comprises machine frame 6 and undercarriages 2 supporting the machine frame for mobility on railroad track 5. At least one vertically and transversely adjustable ballast clearing tool 16 is connected to machine frame 6 for clearing ballast laterally outwardly of a respective rail 3 and for planing the ballast in crib 30 upon vertical and transverse adjustment of tool 16. The tool is longitudinally adjustably mounted on machine frame 6 for adjustment in the direction of the railroad track. Respective preferably hydraulic drive 12, 17 and 8 are connected to the ballast clearing tool for vertically, transversely and longitudinally adjusting the tool.

In the embodiment illustrated in FIGS. 1 and 2, two pairs of ballast clearing tools 16 are arranged on each side of a central longitudinal axis of the railroad track (shown in chain-dotted lines in FIG. 2). The two pairs of ballast clearing tools 16 are associated with each rail 3 to form transversely aligned pairs 29 of ballast clearing tools. Respective tool carriers 9 for the pairs of ballast clearing tools associated with each rail are longitudinally adjustably mounted on longitudinal guides 7 on machine frame 6. Connecting plate 15 interconnects the ballast clearing tools of each pair, the connecting plate and the ballast clearing tools forming a substantially U-shaped yoke straddling the associated rail. Each tool carrier 9 is connected at the longitudinally extending sides of the machine frame with a vertical guide 10 vertically adjustably mounting guide block 11, and vertical adjustment drive 12 enables the guide bock to be vertically adjusted. Transversely extending guide rods 13 connect the two transversely aligned guide blocks 11. The transversely aligned pairs 29 of ballast clearing tools 16 are displaceably mounted on guide rods 13, for which purpose the ballast clearing tools define openings 14 of the same cross section as guide rods 13, the guide rods being received in openings 14. Cylinder-and-piston drive 17 for transverse adjustment of each interconnected pair 29 of ballast clearing tools 16 is mounted intermediate the tools of each pair, the cylinder of drive 17 being affixed to respective guide rod 13 and the piston rod of the drive being connected to the ballast clearing tool adjacent the field side of the associated rail 3. This arrangement of a pair of ballast clearing tools adjacent the field and gage sides of each rial, and preferably two such pairs of tools associated with each rail, assures rapid ballast clearing and planing over the entire width of the ballast bed, including the track shoulder region immediately adjacent the cribs. If the two transversely aligned pairs of ballast clearing tools are connected to a common longitudinal adjustment drive, both pairs of tools may be centered in a crib with this single drive.

Track lifting device 18 is arranged on machine frame 6 centrally between paris 29 of ballast clearing tools 16, the track lifting device comprising lifting rollers 19 which may be pivoted by drive 20 into subtending engagement with the rail head of rail 3. This facilitates not only the ballast clearing and planing operation, particularly in heavily encrusted ballast beds, bu also concomitant tie displacement operations which may be simultaneously performed. For this purpose, as shown in FIG. 2, means 22 for laterally displacing tie 4 is mounted on machine frame 6 between pairs 29 of ballast clearing tools 16. The illustrated tie displacing means comprises a power-driven tie pushing tool including hook 21 arranged for engagement with one tie end and displaceable in the direction of the tie length. Drive 23 is connected to hook 21 for pivoting the hook into engagement with the one tie end about an axis extending in the direction of the track. Hydraulic 24 is connected to tie displacing means 22 for telescopingly displacing the displacing means, i.e. hook 21, transversely to the track whereby tie 4 is pushed out of the track, as shown in dash-dotted lines in FIG. 2. This combination of means for pushing or pulling ties out of the track may simply be arranged on the machine frame or on the tool carriers so that selected ties may be laterally displaced at the same time as the ballast is cleared and planed.

Machine 1 is a self-propelled standard railroad vehicle equipped with drive 25 for independently moving the machine along track 5, the operator's cab 27 including control panel 26 is mounted on machine frame 6 for independent operation of the machine by an operator in cab 27. Flexible hydraulic line 28 is carried by the machine frame and is connected to a central hydraulic power source for supplying power to selected ones of the drives connected to line 28. As shown, machine frame 6 is upwardly recessed for ready accommodation of the longitudinally displaceable ballast clearing device and incorporating machine 1 into a continuously advancing tie replacement installation makes the required ballast clearing operation particularly simple and economical since the power for its operation may be supplied from a central energy source on the installation. If the machine is a standard railroad vehicle, it may be used without difficulty in any railroad track rehabilitation or maintenance work.

The operation of machine 1 for clearing and planing ballast in cribs adjacent successive ties and shoulder regions adjacent the cribs processed in the following manner:

Track lifting rollers 19 are pivoted into engagement with rails 3 and track 5 is slightly lifted off the ballast bed while drives 12 are actuated to lower ballast clearing tools 16 into engagement with the ballast in cribs 30. Drives 17 are then actuated to adjust pairs 29 of the ballast clearing tools transversely from a centered position to a laterally outward position wherein the gage-side tools 16 are close to the associated rials and the field-side tools are a the track shoulders adjacent the opposite ends of the tie. This lateral displacement of the tools in engagement with the ballast causes clearing and planing of the cribs and the adjacent track shoulders since the tools will push any excess ballast to the sides. Subsequently, drives 12 are again actuated to lift the ballast clearing tools and, if necessary, the ballast clearing and planing operation is repeated while longitudinal adjusting drives 8 are actuated to displace the ballast clearing tools longitudinally with respect to continuously advancing machine 1 so that the tools will remain stationary with respect to cribs 30 wherein they operate. As soon as cribs 30 have been satisfactorily cleared and planed, drive 23 is actuated to pivot hook 21 into engagement with one end of tie 4 between the cleared and planed cribs, and transverse displacement drive 24 is actuated to push the tie engaged by hook 21 out of track 5 into a position, such as shown in dash-dotted lines in FIG. 2, wherein it may be manually grasped by an operation for removal or completely withdrawn for conveyance to a freight car. It is also possible to push tie 4 only sufficiently for being clamped by a succeeding tie withdrawing device which will completely withdraw it from the track. The control of all operations may be readily effected by an operator in cab 27 within sigh of the operating devices.

Preferably, the longitudinal displacement path of the ballast clearing tools corresponds to at least twice the width of crib 30 and their transverse adjustment path corresponds to at least a quarter of a tie length. Such a longitudinal displacement path length enables the machine sufficiently and effectively to clear and plane the ballast continuously and without interruption in at least one crib and an adjoining ballast region serving to support a tie adjacent to the crib. The preferred transverse adjustment path length of the ballast clearing tools will assure ballast clearing and planing at lest over the entire width of the track.

Figure 3:
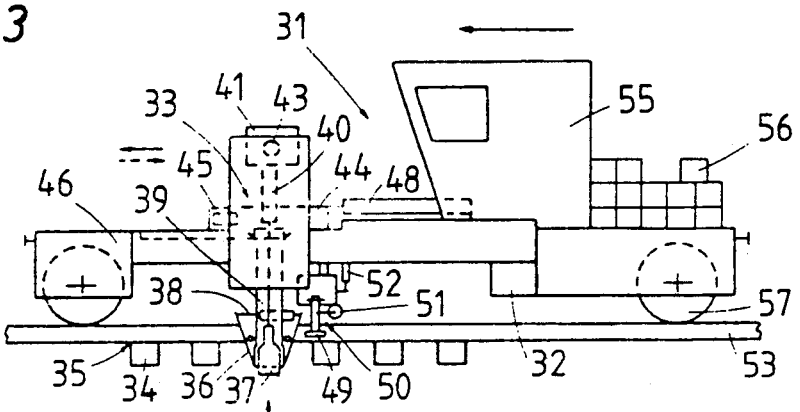
FIG. 3 is a side elevational view of another embodiment of a ballast clearing and planing machine with a track lifting device and a tie puller.
Figure 4:
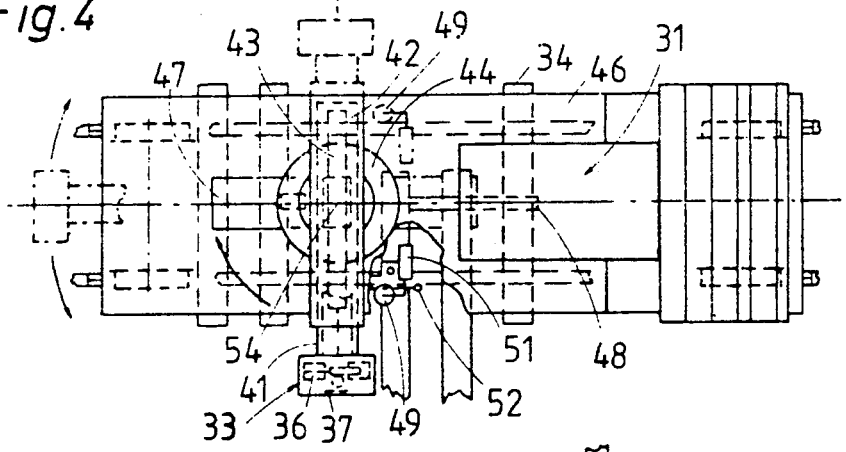
FIG. 4 is a top view of FIG. 3.

FIGS. 3 and 4 illustrate mobile ballast clearing and planing machine 31 which is a standard railroad work vehicle equipped with its own drive 32 and comprising machine frame 46 having a recessed machine frame portion between undercarriages 57 supporting the vehicle on railroad track 35 for mobility in an operating direction. A means for laterally displacing a respective tie 34 of track 35 is mounted in the recessed machine frame portion and comprises power-driven tie pulling tool 33 including tie gripping pincers 36 for clamping an end of the tie arranged adjacent ballast clearing tool 37 mounted between the tie gripping pincers. The plate- or shovel-shaped ballast clearing tool is arranged for clearing and planing the ballast adjacent the tie end. Drive 38 links tie end gripping pincers 36 for pivoting the same into clamping engagement with the tie end. Tool carrier 39 carries the tie end gripping pincers and the ballast clearing tool, and the tool carrier is vertically adjustable by drive 40 with respect to a horizontal guide beam extending transversely to track 35, which is telescopingly displaceable in guide 42 by drive 43. Guide 42 is connected to turntable 44 which is rotatable about vertical axis 54 with respect to machine frame 46 by rotary drive 45. This rotary drive enables tie puller 33 with ballast clearing tool 37 to be selectively positioned at one or the other rail 53 of track 35, i.e. along either longitudinal side of machine frame 46 for pulling tie 34 to one shoulder or the other, as shown respectively in full and dash-dotted lines. A third, central position is also shown in dash-dotted liens and the tie puller is rotated into this rest position when machine 31 is moved from one operating site to another. Turntable 44 is longitudinally displaceably mounted in guide slot 47 of machine frame 46 and is connected to longitudinal displacement drive 48. The machine also comprises track lifting device 50 whose lifting roller 49 at each rail is pivotal by drive 51 into engagement with rail 53 to subtend the rail head, and vertical adjustment drive 52 of the track lifting device enables the rail to be slightly lifted off the ballast bed during the operation of the machine. Depending on the side at which the tie puller is turned, one or the other lifting roller 49 is operated for slightly lifting the rail at which the tie puller and ballast clearing tool is positioned.

When ballast clearing and planing machine 31 is in operation, a stack of new ties 56 or old ties are stored behind operator's cab 55 on machine frame 46. Drive 52 is actuated to propel the machine with this supply of ties to the operating site where rotary drive 45 is actuated to turn tie puller 33 with ballast clearing and planing tool 37 from its central rest position between rails 53 to the operating position shown in full lines in FIG. 4. Longitudinal displacement drive 48 is then actuated to center the tie puller above tie 34 to be pulled and drive 40 is actuated to lower ballast clearing and planing tool 37 into engagement with the ballast immediately adjacent the tie end in the track shoulder. Drive 43 is thereupon actuated to displace ballast clearing and planing tool 37 laterally outwardly away from the tie end whereby the ballast adjacent this tie end is cleared. Lifting roller 49 is now pivoted into engagement with the rail adjacent this tie end and drive 52 is actuated to lift track 35 slightly while clamping drive 38 is actuated to operate tie gripping pincers 36 to grip the tie end. Drive 43 is then actuated again to pull the gripped tie along the cleared ballast shoulder out of the track. The withdrawn tie may be placed on the shoulder or on the machine frame behind cab 55. A new tie 56 may now be placed on the shoulder in position to be gripped by tis gripping pincers 36 and the operation of the tie puller is reversed to inset the new tie into track 35. After this new tie has been fully inserted, the operation is completed and machine 31 is propelled to the next tie or group of ties to be replaced.

Machine 31 is particularly useful for rapid work in such track sections where ties must be immediately replaced to maintain the safety of the track. In this case, the rail fastening elements, such as spikes, are manually removed from the ties to be replaced and are then manually affixed in the new ties. For the efficient operation of machine 31, it is advantageous to carry along a supply of new ties 56 on machine frame 46. However, it is also possible to transport the new ties to the operating site in a separate fright car and to place the new ties on the track shoulder.

Ballast clearing and planing machine 31 may also be incorporated as a preparatory stage into a continuously advancing tie exchange installation, such as disclosed and claimed in the above-named simultaneously filed patent application, in which case longitudinal displaceable tie puller 33 will be used during the continuous advance of the installation to pull the ties to be exchanged only about a third of their length, the complete withdrawal of the ties being effected by a subsequent tie withdrawal device. Such a preparatory stage has the advantage that the tie exchange proper may be effected more rapidly so that the use of this machine makes the continuous tie exchange operation particularly economical.

Figure 5:
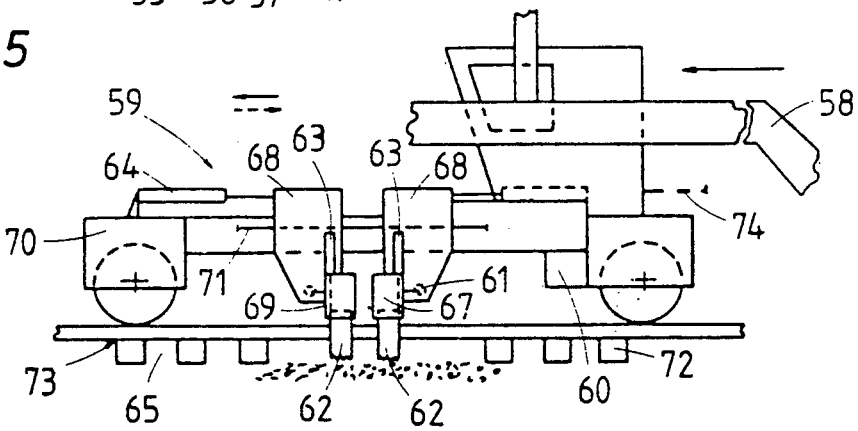
FIG. 5 is a side elevational view of a third embodiment of a ballast clearing and planing machine with an upwardly recessed machine frame.
Figure 6:
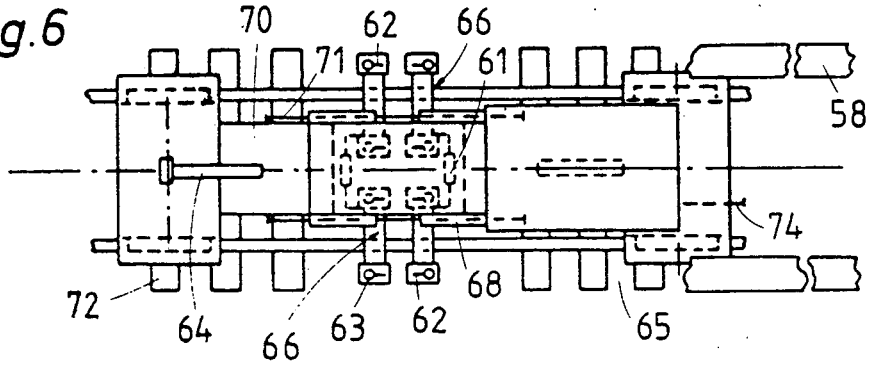
FIG. 6 is a top view of FIG. 5.

FIGS. 5 and 6 show ballast clearing and planing machine 59 with an upwardly recessed machine frame 58 propelled in an operation direction by drive 60. Two pairs 66 of ballast clearing and planing tools 62 are vertically adjustably mounted on respective tool carriers 67 arranged sequentially in the direction of railroad track 73, a separate vertical adjustment drive 63 being connected to each tool 62 for independent vertical adjustment of each tool in the tool carrier. Ballast clearing and planing tools 62 are transversely displaceable by drives 61 into positions at the track shoulders adjacent the ends of ties 72. Each tool carrier is transversely displaceably mounted in transverse guide 69 of support body 68 and each support body is longitudinally displaceably mounted on longitudinal guide 71 of machine frame 70. A longitudinal displacement drive 64 may be connected to each tool carrier 68 or the tool carriers may be coupled to each other and a common longitudinal displacement drive may be connected to the coupled tool carriers whereby the ballast clearing and planing tools may be longitudinally displaced so as to clear and plane a number of adjacent cribs 65 and tie supporting ballast strips. Coupling the two ballast clearing and planing tools associated with each rail facilitates their transverse, vertical and longitudinal displacement whereby the efficiency as well as the accuracy of the ballast clearing operation is enhanced. In addition, it is much easier to observe and monitor the coupled tools during their operation.

This machine is used in track sections from which old ties have previously been withdrawn, as shown in FIG. 5. In operation, ballast clearing and planing tools 62 are lowered by drives 63 and transversely adjusted by drives 61 to clear and plane the ballast. As soon as this ballast clearing operation has been completed, the tools are raised again by drives 63 and transversely adjusted back from the track shoulder towards the center of the track. Longitudinal displacement drive 64 is then actuated to displace tools 62 a little, whereupon a subsequent ballast clearing and planing operation is started to clear an adjacent ballast strip. In this manner, the ballast region between remaining ties 72 in track 73 may be cleared and planed with the sequential longitudinal displacement of tools 62. New ties may subsequently be inserted in the cleared and planed ballast region. Since the width of tools 62 is less than that of cribs 65, it is also possible to use the machine only for clearing a relatively narrow strip of ballast serving, for example, for the support of the new ties. Power may be supplied to the operating drives of machine 59 through flexible hydraulic line 74 connected to a central power plant.

What is claimed is:

1. A mobile machine for clearing and planing ballast supporting a railroad track consisting of rails extending in a longitudinal direction and fastened to ties defining cribs therebetween, which comprises (a) a machine frame, (b) undercarriages supporting the machine frame for mobility on the railroad track, (c) at least one ballast clearing tool defining a plane extending in the longitudinal direction of the track, the ballast clearing tool being vertically and transversely adjustable with respect to the rails and being connected to the machine frame for clearing ballast laterally outwardly of a respective one of the rails and beyond an end of a respective one of the ties, and for planing the ballast upon vertical adjustment of the tool into engagement with the ballast in a respective one of the cribs and transverse adjustment of the vertically adjusted tool in an outward direction transversely to the track, the tool being longitudinally displaceably mounted on the machine frame for horizontal displacement in the longitudinal direction of the track rails into alignment with the respective crib, (d) respective drives for vertically and transversely adjusting, and for longitudinally displacing the tool, and (c) means for laterally displacing the one tie.

2. The mobile ballast clearing and planing machine of claim 1, wherein a respective one of the ballast clearing tools is arranged on each side of a central longitudinal axis of the railroad track, and further comprising a respective tool carrier for each ballast clearing tool, respective ones of the drives for vertically adjusting and longitudinally displacing the tool being connected to each tool carrier, and a respective drive for transversely adjusting the tool being connected to the tool.

3. The mobile ballast clearing and planing machine of claim 1, wherein the longitudinal displacement path of the ballast clearing tool corresponds to at least twice the width of a crib.

4. The mobile ballast clearing and planing machine of claim 1, wherein the transverse adjustment path of the ballast clearing tool corresponds to at least a quarter of a tie length.

5. The mobile ballast clearing and planing machine of claim 1, wherein the ballast clearing tool is arranged adjacent an end of a respective tie, and the tie displacing means comprises a power-driven tie pulling tool including tie gripping pincers for clamping the tie end.

6. The mobile ballast clearing and planing machine of claim 1, wherein the tie displacing means comprises a power-driven tie pushing tool including a tie end engaging hook.

7. The mobile ballast clearing and planing machine of claim 1, wherein two pairs of the ballast clearing tools are associated with a respective one of the rails, and further comprising a track lifting device arranged between the pairs of ballast clearing tools.

8. The mobile ballast clearing and planing machine of claim 1, wherein the machine frame has an upwardly recessed frame portion between the undercarriages and the ballast clearing tool is connected to the upwardly recessed frame portion.

9. The mobile ballast clearing and planing machine of claim 8, further comprising a flexible hydraulic line carried by the machine frame and connected to a central hydraulic power source for supplying power to the drives.

10. The mobile ballast clearing and planing machine of claim 1, further comprising a drive for independently moving the machine along the track, and an operator's cab including a control panel mounted on the machine frame for independent operation of the machine.

11. The mobile ballast clearing and planing machine of claim 10, wherein the machine is a standard railroad vehicle.

12. The mobile ballast clearing and planing machine of claim 1, wherein two pairs of said ballast clearing tools are arranged on each side of a central longitudinal axis of the railroad track and are associated with a respective one of the track rials, and further comprising a respective tool carrier for each pair of the ballast clearing tools, a transversely extending connecting plate interconnecting the ballast clearing tools of each pair whereby the tools form transversely aligned pairs of tools arranged at respective sides of each track rail, and a longitudinally extending guide means on the machine frame for longitudinally adjusting mounting the tool carriers, respective ones of the drives for vertically adjusting and longitudinally displacing the tools being connected to each tool carrier and respective drives for transversely adjusting the tools being connected to each pair of the tools.

* * * * *